US006936075B2

(12) United States Patent
Vogt et al.

(10) Patent No.: US 6,936,075 B2
(45) Date of Patent: Aug. 30, 2005

(54) TEXTILE SUBSTRATES FOR IMAGE PRINTING

(75) Inventors: Kirkland W. Vogt, Simpsonville, SC (US); Kimberly C. Gillis, Moore, SC (US); Daniel T. McBride, Chesnee, SC (US); John A. Soltis, LaGrange, GA (US); William T. Sims, Simpsonville, SC (US)

(73) Assignee: Milliken, Spartanburg, SC (US)

( * ) Notice: Subject to any disclaimer, the term of this patent is extended or adjusted under 35 U.S.C. 154(b) by 142 days.

(21) Appl. No.: 09/772,800

(22) Filed: Jan. 30, 2001

(65) Prior Publication Data

US 2002/0132541 A1 Sep. 19, 2002

(51) Int. Cl.[7] ..... D06M 13/00; B32B 27/12

(52) U.S. Cl. ..... 8/115.51; 8/115.54; 8/445; 8/478; 8/495; 428/85; 428/91; 428/96; 442/59; 442/79; 442/82; 442/83; 442/84; 442/86; 442/88; 442/89; 442/90; 442/181; 442/304; 442/327

(58) Field of Search ..... 8/115.51, 115.54, 8/478, 445, 495; 428/85, 91, 96; 442/59, 79, 82, 83, 84, 86, 88, 89, 90, 181, 304, 327, 64, 81; 427/412

(56) References Cited

U.S. PATENT DOCUMENTS

| | | | | |
|---|---|---|---|---|
| 3,589,906 | A | 6/1971 | McDowell | 96/87 |
| 4,027,049 | A | 5/1977 | Masuda et al. | 427/19 |
| 4,397,650 | A | 8/1983 | Gregorian et al. | 8/477 |
| 4,554,181 | A | 11/1985 | Cousin et al. | 427/261 |
| 4,740,214 | A | 4/1988 | McBride et al. | 8/561 |
| 4,786,288 | A | 11/1988 | Handa et al. | 8/495 |
| 4,808,191 | A | 2/1989 | Gregory et al. | 8/478 |
| 5,143,991 | A | 9/1992 | Amimoto et al. | 526/245 |
| 5,192,617 | A | 3/1993 | Stofko et al. | 428/411.1 |
| 5,208,092 | A | 5/1993 | Iqbal | 428/195 |
| 5,372,884 | A | 12/1994 | Abe et al. | 428/331 |
| 5,376,727 | A | 12/1994 | Iqbal et al. | 525/196 |
| 5,403,358 | A | 4/1995 | Aston et al. | 8/445 |
| 5,429,860 | A | 7/1995 | Held et al. | 428/195 |
| 5,510,415 | A | 4/1996 | Zahrobsky et al. | 524/506 |
| 5,537,137 | A | 7/1996 | Held et al. | 347/105 |
| 5,631,684 | A | 5/1997 | Takaide et al. | 347/100 |
| 5,660,928 | A | 8/1997 | Stokes et al. | 428/331 |
| 5,698,478 | A | 12/1997 | Yamamoto et al. | 442/153 |
| 5,709,748 | A | 1/1998 | Sassa et al. | 118/262 |
| 5,714,082 | A | 2/1998 | Boardman et al. | 252/8.62 |
| 5,770,531 | A | 6/1998 | Sudduth et al. | 442/361 |
| 5,853,861 | A | 12/1998 | Held | 428/207 |
| 5,916,673 | A | 6/1999 | Fryberg et al. | 428/328 |
| 5,925,712 | A | 7/1999 | Kronzer | 524/555 |
| 5,962,149 | A | 10/1999 | Kronzer | 428/537.5 |
| 6,001,137 | A | 12/1999 | Alfekri et al. | 8/445 |
| 6,020,032 | A | 2/2000 | Romano, Jr. et al. | 427/411 |
| 6,033,739 | A | 3/2000 | Kronzer | 427/391 |
| 6,054,399 | A | 4/2000 | Lebold et al. | 442/98 |
| 6,096,469 | A | 8/2000 | Anderson et al. | 430/119 |
| 6,103,364 | A | 8/2000 | Harris et al. | 428/326 |
| 6,120,888 | A | 9/2000 | Dolsey et al. | 428/222 |
| 6,153,263 | A | 11/2000 | Haruta et al. | 427/261 |
| 6,156,072 | A | 12/2000 | Usui et al. | 8/115.6 |
| 6,214,417 | B1 | 4/2001 | Watanabe et al. | 427/394 |
| 6,270,214 | B1 | 8/2001 | Smith et al. | 347/101 |
| 6,465,078 | B1 | 10/2002 | Kawai et al. | 428/32.26 |

FOREIGN PATENT DOCUMENTS

| | | |
|---|---|---|
| JP | 60-99081 | 6/1985 |
| WO | WO 99/54144 | 10/1999 |

OTHER PUBLICATIONS

International Search Report PCT/US01/47384 filed Dec. 10, 2001; Textile Substrates for Image Printing; Our Case No. 5138.

Written Opinion for PCT/US01/47384 filed Dec. 10, 2001; Textile Substrates for Image Printing; Our Case No. 5138. SciFinder; Ink–Jet; Nov. 2001; pp. 2–3.

*Primary Examiner*—Ula Ruddock
(74) *Attorney, Agent, or Firm*—Terry T. Moyer; Jeffery E. Bacon

(57) ABSTRACT

A textile coated with a coating having cationic and repellant properties, thereby accepting an image thereon more readily.

65 Claims, No Drawings

TEXTILE SUBSTRATES FOR IMAGE PRINTING

BACKGROUND

The present invention generally relates to placing images on textiles, and in particular, to the treatment of textiles for enhancing the definition of the image placed upon the textile.

Images are placed upon a substrate by various methods such as digital printing. Digital printing is the process of placing various small predetermined quantities of a colorant, known as pixels, in predetermined matrix zones of a substrate. Colorants can include dyes, pigments, polymeric colorants, or combinations thereof. Additionally, colorants can include different types and colors of dyes and/or pigments. The pixels can be placed on the substrate by various methods, such as ink jet printing. Typically, digital printing uses a limited small number of different colorants, and only one of these colorants is used for a particular pixel. Variations in colors and shades in digital printing is generally accomplished in digital printing by positioning different colored pixels in adjacent or near-by matrix zones. Although the actual color of the individual pixels is not changed, the impression to a viewer is that the area containing the different colored pixels is a color or shade that is different than any of the actual pixels in the associated area. The impression is created because the pixels are of such a small nature that the viewer cannot readily perceive the individual pixels, and perceives more of an average of the pixels.

Placing images on textiles presents various difficulties not experienced in all substrates. It has been discovered by the inventors of the present invention that, due to the nature of the material in a textile, or the construction of the textile, the color medium (such as ink) used to place the image on the textile may not fill the intended zone for the medium, may bleed outside of the intended zone, or may be absorbed into the textile substrate. If the color medium does not fill the intended zone, the image placed on the textile can lose color intensity due to the presence of the underlying textile substrate color. If the color medium is absorbed into the textile, color intensity can be lost due to at least a portion of the color medium being disposed in an area of the textile that cannot be seen, and/or by the color medium failing to fill the intended zone. If the color medium bleeds outside of the intended zone, image acuity and intensity can be impacted.

These problems are of greater concern with digital printing, where the intended zones for the color medium are smaller and closer together. Furthermore, methods to correct these problems can increase the ability of the textile substrate to lose colorant due to rubbing contact with another surface. Therefore, there is a need for textiles, textile treatments, and methods which reduce the difficulties in placing an image on textiles.

DETAILED DESCRIPTION

In one embodiment of the present invention, a coating having cationic and repellant characteristics are coated onto the surface of a textile to receive an image by processes such as digital printing. The coating can be a combination of a cationic material and a repellant finish.

Generally, the textile materials can include banner or sign fabrics, upholstery fabrics, drapery fabrics, napery fabrics, carpeting, and the like. The textile can be a woven, knitted, non-woven material, tufted materials, and the like. Woven textiles can include, but are not limited to, satin, poplin, and crepe weave textiles. In one embodiment, the textile is a woven textile, and has from about 15 to about 75 picks per inch, from about 15 to about 175 ends per inch, and can be a satin weave. Knit textiles can include, but are not limited to, circular knit, warp knit, and warp knit with a microdenier face. In one embodiment, the textile is a warp knit fabric with from about 12 to about 50 wales per inch, and from about 10 to about 60 courses per inch. Such textile materials can be formed of natural or synthetic fibers, such as polyester, nylon, wool and acrylic, including textile materials containing mixtures of such natural and synthetic fibers.

Cationic material are materials that have a positive charge. It is believed that the cationic material helps hold the color medium on the surface of the intended zone, thereby reducing any bleeding of the color medium into unintended areas or absorption of the color medium into the textile. Cationic materials that can be used for the present invention include, but are not limited to, polymeric, non-polymeric organic compounds, and metal salts. Polymeric cationic materials and non-polymeric organic cationic materials include nitrogen containing materials and phosphorus containing materials. Nitrogen containing cationic materials include, but are not limited to, primary amine (such as polyvinylamine or polyallyamine), secondary amine, tertiary amine, quaternary amine, and amines converted to cationic amines under acidic conditions. Examples of nitrogen containing cationic polymer materials include homopolymers or copolymers of cationic monomers. Cationic monomers can include diallyldimethylammonium chloride, or methacrylamidopropyltrimethyl ammonium chloride, or the like. Phosphorus containing cationic material include, but are not limited to, the phosphonium group. Examples of a phosphonium group cationic material include stearyltributyl phosphonium bromide, or the like.

Metal salts that can be used for the present invention include water soluble salts of cations from Group II, Group II, or the Transition Metals of the Periodic Table. Examples include magnesium, calcium, aluminum, zinc, and zirconium. In a preferred embodiment, the salts have an anion of a weak acid, such as acetate forming or the like.

It has been found that the use of a combination of quaternary polymer and a multivalent metal salt as the cationic coating material is particularly effective as a treatment for fabric to receive an image such as from digital printing.

Repellant finishes include fluorochemicals, silicones, resin-based finishes, waxes, wax-metal emulsions, organometallic complexes, and combinations thereof. It is believed that the repellant properties of the repellant finishes help prevent the color medium from being absorbed into the textile, and facilitates allowing the color medium to fill the entire intended zone for the color medium.

Fluorochemical repellants include chemicals that contain perfluorocarbon groups. In one embodiment, the fluorochemical repellants are the products of copolymers of perfluoroalkyl acrylates or methacrylates with other comonomers. The comonomers include esters of acrylic or methacrylic acid containing alkyl groups, alkylamide groups, or polyether groups. In one embodiment, the Fluorochemical repellants can be emulsions or solvent solutions for application to the textile material.

Silicone repellants include polymers of methyl(hydrogen) siloxane and dimethylsiloxane. In one embodiment, the silicones are an aqueous emulsion or a solvent solution for application to the textile material.

Resin-based finishes include modified melamine formaldehyde resin based finishes, and can be blended with waxes. In one embodiment, the resin-based finishes are a water soluble material such as AEROTEX M3™ from BF Goodrich for application to the textile material.

The image on the textile is created by a colorant. The colorant can be dyes, pigments, polymeric colorants, or a combination thereof, and can be a component of a material such as an ink. The ink can be an aqueous and/or non-aqueous solution based material, with the colorant being a dispersion or a solution therein. An example of the aqueous dispersion type ink is the DI Series (Yellow GWL, etc.) from Ciba, Inc. An example of a non-aqueous solvent type ink is the PzO Series (cyan, magenta, yellow etc.) from A.R. Monteith. Inc.

In a procedure of the present invention, the coating having cationic and repellant properties is applied to the textile and then the image is placed upon the surface of the textile having the coating thereon. In one embodiment, the coating is applied to the textile substrate in an aqueous solution. The aqueous solution can be applied to the surface of the textile to receive the image, or the entire textile can be dipped into the aqueous solution. After the acqueous coating is place on the textile, the textile is typically squeezed between rolls to remove excess aqueous solution, and then dried. The image can be placed on the textile using digital printing, such as from a digital or ink jet printer.

The present invention can be further understood with reference to the following examples:

EXAMPLES 1–6

A polyester fabric was dipped into a variety of aqueous baths of the chemical coatings listed below in Table 1. The fabric was a Sateen Weave with 152 ends per inch and 70 picks per inch. The warp yarn was a 1/70/34 polyester, warp drawn yarn. The fill yarn was a 1/150/34 textured polyester The base fabric weighed about 3.1 oz/sq. yd.

Example 6, is a 3-(trimethoxysilyl)propydimethyloctadecyl ammonium chloride by Dow Corning, and demonstrates the present invention utilizing a coating chemical having both cationic and hydrophobic properties. Another coating chemical that can be used for the present invention that have both cationic and hydrophobic properties includes melamine-formaldehyde resin.

The chemical coatings were applied in aqueous form by dipping the fabric into a water based bath of the chemicals listed in Table 1. After the fabric was coated with the aqueous solution of the chemical coatings, the coated fabric was squeezed between rolls and dried at 360F. for 2 minutes. The % of add-on is the difference between the weight of the fabric before and after the chemical coatings are applied, divided by the weight of the fabric before addition of the chemical coatings and multiplied by 100.

The coated fabric was printed with an HP 660C digital printer with a test pattern of 1 inch diameter black, red, yellow, and red dots, and 4 pt. black and red lines. The inks used were pigment based (Black), or acid dye based (red, yellow, blue).

The color of the dots was measured with a HunterLab DP-9000 colorometer. The variations in color intensity between samples and the fabric background was measured with a modification of The Engineering Society for Advancing Mobility Land Sea Air and Space Textile Test method SAE J-1885, "(R) Accelerated Exposure of Automotive Interior Trim Components Using a Controlled Irradiance Water Cooled Xenon-Arc Apparatus". The modification of the test was that the initial measurement was on the background (or area not printed) and the final measurement was on the printed area. The color intensity, $\Delta E_p$, is generally calculated by the following equation:

$$\Delta E_p=((L_{background}-L_{printed})^2+(a_{background}-a_{printed})^2+(b_{background}-b^*_{printed})^2)^{1/2}$$

wherein $\Delta E_p$ represents the difference in color between the background fabric and the fabric after printing. L, a, and b are the color coordinates; wherein L is a measure of the lightness and darkness of the colored fabric; a is a measure of the redness or greenness of the colored fabric; and b is a measure of the yellowness or blueness of the colored fabric. Greater $\Delta E_p$ value result in a higher intensity of the color.

The acuity ratio (AR) was calculated by printing the black and red 4 pt. line in both warp and fill directions and measuring the greatest width that the ink wicked away from the line under a light microscope and dividing by the theoretical line width.

TABLE 1

| Example | Chemical Formulation | % add-on | ΔE Black | ΔE Red | ΔE Yellow | ΔE Blue | AR Black Warp | AR Black Fill | AR Red Warp | AR Red Fill |
|---|---|---|---|---|---|---|---|---|---|---|
| Control | N/A | 0% | 65.6 | 53.8 | 47.5 | 51.5 | 1.3 | 2.3 | 1.3 | 3.3 |
| 1 | 15% Polycat M-30 3% Foraperle 501 | 3.2% | 69.4 | 63.5 | 65.9 | 58.2 | 1 | 1.2 | 1 | 1.2 |
| 2 | 15% Polycat M-30 1% Foraperle 501 | 3.5% | 69.5 | 63.8 | 65.6 | 57.3 | 1 | 1.2 | 1 | 1.2 |
| 3 | 15% Polycat M-30 0.5% Foraperle 501 | 3 0% | 69.5 | 63.0 | 64.6 | 56.3 | 1 | 1.2 | 1 | 1.3 |
| 4 | 15% Polycat M-30 0.5% Repearl 8025 | 3.0% | 67.8 | 60.6 | 56.7 | 57.8 | 1 | 1 | 1 | 1 |
| 5 | 35% Nalco 2010 1% Foraperle 501 | 4 3% | 70.6 | 69.1 | 77.4 | 59.5 | 1 | 1.3 | 1 | 1.2 |
| 6 | 25% Dow Corning 5700 | 4.5% | 68.4 | 38.0 | 45.3 | 3.74 | 1 | 1.3 | 1 | 1.3 |

In Table 1, the percentages of the chemicals listed in the Chemical Formulation column are by weight of the total aqueous bath of the chemical coatings. In the Chemical Formulation column of Table 1, POLYCAT M30™ is a quaternary stilbene vinyl copolymer by Peach State Labs; FORAPERLE 501™ is a fluorochemical dispersion by Atofina; REPEARL 8025™ is a fluorochemical dispersion by Mitsubishi Chemical; and Nalco 2010™ is a diallyldimethylammonium chloride (DADMAC) polymer by Nalco. Dow Coming 5700™ listed as the Chemical Formulation in The results in Table 1 demonstrate the effects of changing concentration of repellant finish, type of repellant finish or cationic chemical, and total solids add-on.

What is claimed is:

1. A device comprising:

a textile substrate having a first surface;

a coating on the first surface of said textile substrate, said coating including a cationic material and a repellant finish.

2. The device according to claim 1, wherein the cationic material of said coating comprises a material selected from the group consisting of: polymeric and non-polymeric organic compounds.

3. The device according to claim 2, wherein the cationic material of said coating comprises a nitrogen containing material.

4. The device according to claim 3, wherein the nitrogen containing material is selected from the group consisting of: primary amine, secondary amine, tertiary amine, and quaternary amine.

5. The device according to claim 3, wherein the nitrogen containing material includes amines converted to cationic amines under acidic conditions.

6. The device according to claim 3, wherein the nitrogen containing material comprises a primary amine selected from the group consisting of: polyvinylamine and polyallylamine.

7. The device according to claim 3, wherein the nitrogen containing material comprises homopolymers of cationic monomers.

8. The device according to claim 7, wherein said cationic monomers includes material selected from the group consisting of diallyldimethylammonium chloride and methacrylamidopropyltrimethyl ammonium chloride.

9. The device according to claim 3, wherein the nitrogen containing material comprises copolymers of cationic monomers.

10. The device according to claim 9, wherein said cationic monomers includes material selected from the group consisting of diallyldimethylammonium chloride and methacrylamidopropyltrimethyl ammonium chloride.

11. The device according to claim 2, wherein the cationic material of said coating comprises a phosphorus cationic material.

12. The device according to claim 11, wherein the phosphorus cationic material comprises phosphonium.

13. The device according to claim 12, wherein said repellant finish comprises a copolymer of methacrylate.

14. The device according to claim 13, wherein said repellant finish further includes comonomers.

15. The device according to claim 14, wherein said additional comonomers include esters of acrylic or methacrylic acid containing material selected from the group consisting of: alkyl groups, alkylamide groups, and polyether groups.

16. The device according to claim 2, wherein the cationic material comprises a metal salt material.

17. The device according to claim 16, wherein the metal salt material comprises a water soluble salt of cations selected from the group of the periodic table consisting of: Group II, Group III, and the Transition Metals.

18. The device according to claim 16, wherein the metal salt material comprises a water soluble salt of cations selected from the group of cations consisting of: magnesium, calcium, aluminum, zinc, and zirconium.

19. The device according to claim 16, wherein the metal salt material includes an anion of a weak acid.

20. The device according to claim 2, wherein the cationic material comprises a quaternary polymer and a multivalent metal salt.

21. The device according to claim 1, further including an image disposed on the first surface of said textile having the coating thereon.

22. The device according to claim 21, wherein the image disposed on said textile comprises a colorant selected from the group consisting of: dyes, pigments, and polymeric colorants.

23. The device according to claim 1, wherein said textile comprises a woven fabric.

24. The device according to claim 23, wherein the woven fabric is selected from the group consisting of: satin weave fabrics, poplin weave fabrics, and crepe weave fabrics.

25. The device according to claim 23, wherein said woven fabric includes from about 15 picks per inch to about 75 picks per inch.

26. The device according to claim 23, wherein said woven fabric includes from about 15 ends per inch to about 175 ends per inch.

27. The device according to claim 1, wherein said textile comprises a knit fabric.

28. The device according to claim 28, wherein the knit fabric is selected from the group consisting of: circular knit fabrics, warp knit fabrics, and warp knit fabrics having a microdenier face for the first surface.

29. The device according to claim 27, wherein said knit fabric comprises a warp knit fabric having from about 12 wales per inch to about 50 wales per inch.

30. The device according to claim 27, wherein said knit fabric comprises a warp knit fabric having from about 12 courses per inch to about 50 courses per inch.

31. The device according to claim 1, wherein said textile comprises a nonwoven material.

32. The device according to claim 1, wherein said textile comprises a tufted material.

33. The device according to claim 1, wherein said textile includes fibers selected from the group consisting of: polyester, nylon, wool, and acrylic.

34. The device according to claim 1, wherein said textile comprises a sign fabric.

35. The device according to claim 1, wherein said textile comprises a upholstery fabric.

36. The device according to claim 1, wherein said textile comprises a drapery fabric.

37. The device according to claim 1, wherein said textile comprises a napery fabric.

38. The device according to claim 1, wherein said textile comprises carpeting.

39. The device according to claim 1, wherein the repellant finish of said coating includes a repellant material selected from the group consisting of: a fluorochemical; a silicon; a resin-based finish; a wax; a wax-metal emulsion; and an organometallic complex.

40. The device according to claim 39, wherein said repellent finish comprises a copolymer of perfluoroalkyl acrylate.

41. The device according to claim 40, wherein said repellant finish further includes comonomers.

42. The device according to claim 41, wherein said additional comonomers include esters of acrylic or methacrylic acid containing material selected from the group consisting of: alkyl groups, alkylamide groups, and polyether groups.

43. The device according to claim 1, wherein said repellant finish includes polymers of dimethylsiloxane.

44. The device according to claim 1, said repellent finish includes polymers of dimethylsiloxane.

45. A device comprising:

a textile substrate having a surface;

a coating on the surface of said textile substrate, said coating including a cationic material and a fluorochemical.

46. The device according to claim 45, wherein said fluorochemical comprises a fluorocarbon dispersion.

47. The device according to claim 45, further including an image disposed on the surface of said textile having the coating thereon.

48. The device according to claim 45, wherein the image disposed on said textile comprises a colorant selected from the group consisting of: dyes, pigments, and polymeric colorants.

49. The device according to claim 45, wherein said textile comprises a woven fabric.

50. The device according to claim 49, wherein the woven fabric is selected from the group consisting of: satin weave fabrics, poplin weave fabrics, and crepe weave fabrics.

51. The device according to claim 49, wherein said woven fabric includes from about 15 picks per inch to about 75 picks per inch.

52. The device according to claim 49, wherein said woven fabric includes from about 15 ends per inch to about 175 ends per inch.

53. The device according to claim 45, wherein said textile comprises a knit fabric.

54. The device according to claim 53, wherein the knit fabric is selected from the group consisting of: circular knit fabrics, warp knit fabrics, and warp knit fabrics having a microdenier face for the first surface.

55. The device according to claim 53, wherein said knit fabric comprises a warp knit fabric having from about 12 wales per inch to about 50 wales per inch.

56. The device according to claim 53, wherein said knit fabric comprises a warp knit fabric having from about 12 courses per inch to about 50 courses per inch.

57. The device according to claim 45, wherein said textile comprises a nonwoven material.

58. The device according to claim 45, wherein said textile comprises a tufted material.

59. The device according to claim 45, wherein said textile includes fibers selected from the group consisting of: polyester, nylon, wool, and acrylic.

60. The device according to claim 45, wherein said textile comprises a sign fabric.

61. The device according to claim 45, wherein said textile comprises a upholstery fabric.

62. The device according to claim 45, wherein said textile comprises a drapery fabric.

63. The device according to claim 45, wherein said textile comprises a napery fabric.

64. The device according to claim 45, wherein said textile comprises carpeting.

65. A device comprising a textile coated with a cationic material and a repellant finish, wherein said repellant finish comprises a repellant selected from the group consisting of: a fluorochemical, a wax, a wax-metal emulsion, and an organometallic complex, wherein said textile further comprises an image, the image having a color intensity of greater than 68.4 for the color black.

* * * * *

UNITED STATES PATENT AND TRADEMARK OFFICE

CERTIFICATE OF CORRECTION

PATENT NO. : 6,936,075 B2
DATED : August 30, 2005
INVENTOR(S) : Vogt et al.

It is certified that error appears in the above-identified patent and that said Letters Patent is hereby corrected as shown below:

Column 6,
Line 67, please delete “dimethylsiloxane” after the words “polymers of” and insert -- methyl(hydrogen)siloxane) --.

Signed and Sealed this

Twenty-second Day of November, 2005

JON W. DUDAS
*Director of the United States Patent and Trademark Office*